United States Patent [19]

Sugiyama et al.

[11] Patent Number: 4,636,154

[45] Date of Patent: Jan. 13, 1987

[54] HORIZONTAL TYPE ROTARY COMPRESSOR

[75] Inventors: Masahiko Sugiyama, Tochigi; Masatune Sutou, Ota; Mitsuru Murata, Tochigi; Minoru Ooki, Oyama; Shigetaro Tagawa, Tochigi, all of Japan

[73] Assignee: Hitachi, Ltd., Tokyo, Japan

[21] Appl. No.: 740,818

[22] Filed: Jun. 3, 1985

[30] Foreign Application Priority Data

Jun. 4, 1984 [JP] Japan ..... 59-112932

[51] Int. Cl.[4] ..... F01G 21/04

[52] U.S. Cl. ..... 418/97; 418/DIG. 1; 184/6.16

[58] Field of Search ..... 418/181, 97, DIG. 1; 184/6.16, 11.1, 13.1

[56] References Cited

U.S. PATENT DOCUMENTS

| | | | |
|---|---|---|---|
| 2,764,342 | 9/1956 | Dills | 418/181 |
| 3,130,902 | 4/1964 | Brown | 418/63 |
| 4,342,547 | 8/1982 | Yamada | 418/DIG. 1 |

FOREIGN PATENT DOCUMENTS

| | | | |
|---|---|---|---|
| 2111596 | 7/1983 | United Kingdom | 418/DIG. 1 |

*Primary Examiner*—Carlton R. Croyle
*Assistant Examiner*—Jane E. Obee
*Attorney, Agent, or Firm*—Antonelli, Terry & Wands

[57] ABSTRACT

A horizontal type rotary compressor comprising radial partitioning walls in a discharge silencer. A slant portion is formed in the partitioning walls thereby enabling the oil within the discharge silencer to be discharged to the outside of the silencer. Thus, a noise generation due to a cavity resonance in the discharge silencer and an impact noise of a discharge valve in the oil may be prevented. At the same time, a carbonization of the oil, caused by an increase of the oil temperature, may also be prevented.

9 Claims, 14 Drawing Figures

HORIZONTAL TYPE ROTARY COMPRESSOR

BACKGROUND OF THE INVENTION

The present invention relates to a rotary compressor and, more particularly, to a rotary compressor having a high operational efficiency.

DESCRIPTION OF THE PRIOR ART

In a conventional compressor such as shown in FIG. 1 an electric drive element 2 and a compression element 3 are encased in a casing 1 and an oil 20, mixed with a refrigerant sealingly filled in the casing 1 is accommodated in an oil reservoir located below the compression element 3. A rotational torque of the electric drive element 2 is transmitted through a substantially horizontally disposed rotary shaft 4 to the compression element 3, thereby driving a roller 7 which is eccentrically rotated in an inner wall of a cylinder 6 so as to cause the refrigerant to be compressed as shown most clearly in FIGS. 2, 3.

Referring to FIG. 3, a low pressure gas is sucked into the cylinder 6 through a pipe 27 extending in parallel to the rotary shaft 4, with the low pressure gas being compressed by the roller 7. The discharge gas 21, compressed to be a high pressure gas, is discharged from a discharge port 15 of a sub-bearing 9 shown in FIG. 1 to a discharge silencer 22 formed in the sub-bearing 9. A discharge valve 16 opens and closes the discharge port 15 by the suction and discharge effects of the cylinder 6. A valve retainer 17 restricts an operational range of opening and closing of the discharge valve 16. The discharge gas 21 is discharged into the casing 1 through discharge gas passages 18*a*, 18*b* and 18*c* and then introduced through a discharge pipe 19 into the high pressure side of the refrigerating cycle.

Referring to FIG. 2, a vane 8 always presses the roller 7 by the action of a spring 12 provided at a lower end of the vane 8 and serves to partition the interior of the cylinder 6 into a high pressure chamber 25 and a low pressure chamber 24. The vane 8 is reciprocatingly moved in compliance with the rotation of the rotary shaft 4. A back space 8' of the vane 8 is utilized to form an oil supply pump since a volume of the back space 8' is changed during an operational cycle. A suction piece 13 (FIG. 1) is fixed below a main bearing 5, with the suction piece 13 having a tapered shape for sucking the oil. A tapered discharge hole 14 is formed in the sub-bearing 9, and the oil 20*a*, passing through the discharge hole 14, is fed through a feed pipe 11 into an interior of the shaft 4 by the pumping action of the vane 8. The fed oil 20*a* lubricates the sliding portions between the rotary shaft 4 and the main bearing 5, the sub-bearing 9 and the roller 7 from an oil hole 4*a* formed in the shaft 4. However, the oil 20*a* which is maintained at a high temperature and a high pressure and fills the inside of the roller 7 leaks into the low pressure cylinder chamber 24 through a clearance extending in the radial direction of the roller 7 and the cylinder 6, as indicated by the arrows in FIG. 2, and is discharged into the interior of the discharge silencer 22 together with the discharge gas 21 as shown in FIG. 1. As a result, the high temperature refrigerant contained in the oil 20*a* evaporates and invades the refrigerating cycle, thereby reducing the refrigerating performance.

An amount of work or energy will increase corresponding an extent at which the high temperature oil enters into the low pressure chamber, so that the expended electric power will increase. Furthermore, in some cases, the oil affects the generation of noises of the compressor and, for example, in the conventional compressor, when the suction pressure is lowered, a noise level within an 800 Hz range would be increased.

In order to study causes of such noises, an experimental study was conducted under the following conditions. Namely, a planar cover 10 of a compressor, shown in FIG. 1, was made of glass and parts of an end face of the casing 1 were made also of glass. Then, the state of interior of the discharge silencer 22 was observed therethrough.

From such an experimental compressor, it was found that the great amount of oil 20*a* was stagnant in the interior of the discharge silencer 22 of the conventional compressor of FIG. 1.

Measurement results of the observation of the compressor shown in FIG. 4 are shown in FIG. 5. Which confirm that the noise level within the 800 Hz range, as indicated by the solid line in FIG. 5, was high and variable. The cause of the noises was that, when the discharge valve 16 formed in the discharge silencer 22 was dipped into the oil 20*a*, upon the actuation of the discharge valve 16, the discharge valve 16 was abutted against the oil, thereby generating collison or impact noises.

In a conventional compressors of the type disclosed, for example, in U.S. Pat. No. 3,310,902, an arrangement is proposed to cope noises generated due to a cavity resonance within the discharge silencer.

More particularly, in the above noted patent a structure is proposed wherein a plurality of radial partitioning walls are provided in the interior of the discharge silencer, thereby preventing the generation of the noises due to the cavity resonance thereof.

However, in the proposed structure, no discharge means are provided for discharging the stagnant oil within the discharge silencer. Thus, there is no countermeasure against the reduction of the refrigerating performance due to the high temperature and high pressure refrigerant mixed with the high temperature oil, a reduction of compression efficiency of the compressor or the generation of noises.

Accordingly, an object of the present invention resides in providing a compressor for preventing not only a stagnation of oil within a discharge silencer, but also a reduction of refrigerating performance, and a reduction of compression efficiency of the compressor and a generation of noises.

In order to attain the above-noted object, according to the present invention, a compressor is proposed wherein a slant portion is provided at a part of radial partitioning walls formed in the discharge silencer, thereby enabling a discharge of the oil from the discharge silencer.

DETAILED DESCRIPTION

Figure 1:
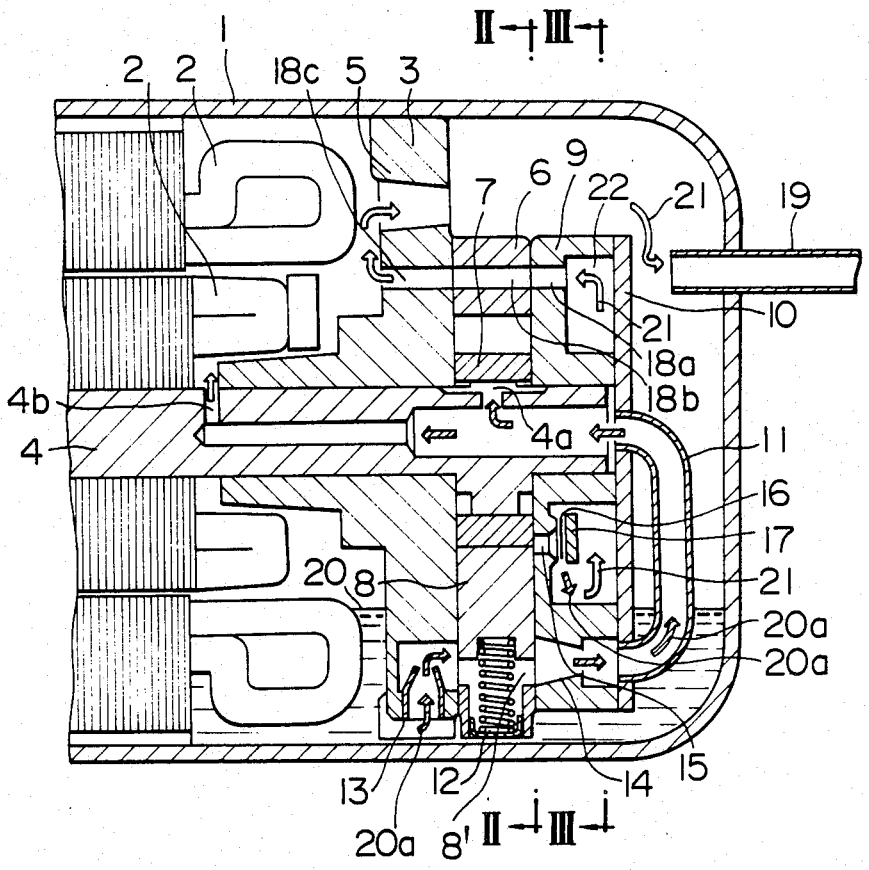
FIG. 1 PRIOR ART
FIG. 1 is a longitudinal sectional view of a conventional compressor.
Figure 2:
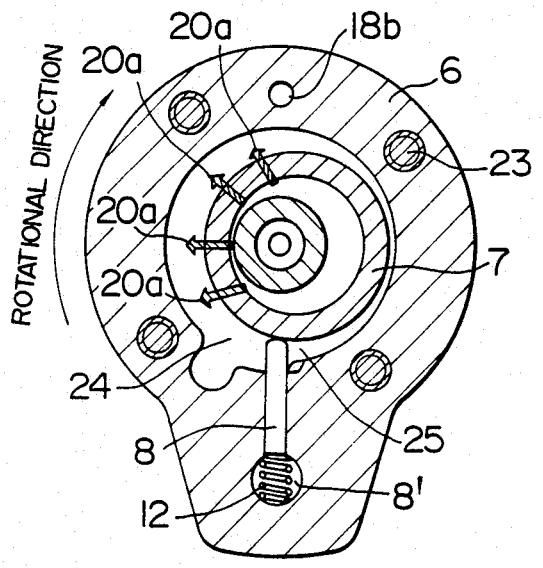
FIG. 2 PRIOR ART
FIG. 2 is a cross-sectional view taken along the line II—II of FIG. 1.
Figure 3:
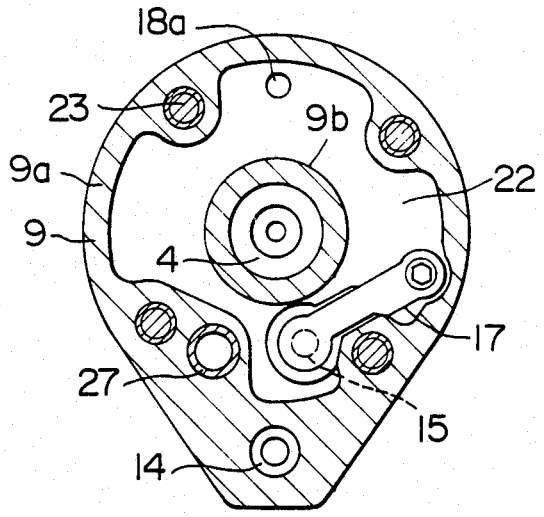
FIG. 3 PRIOR ART
FIG. 3 is a cross-sectional view taken along the line III—III of FIG. 1.
Figure 4:
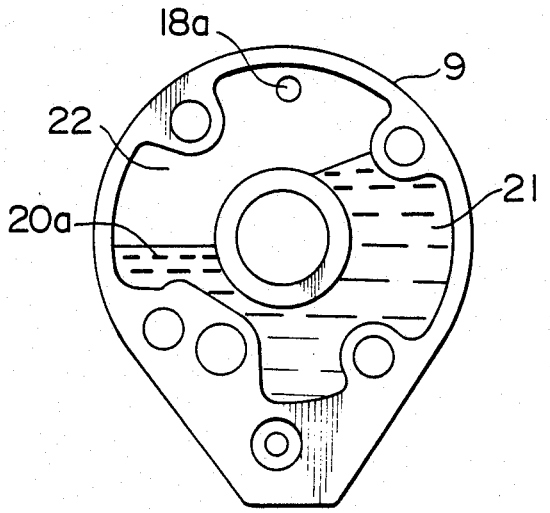
FIG. 4 PRIOR ART
FIG. 4 is a front elevational view of a discharge silencer of the conventional compressor of FIG. 1 during operation thereof.
Figure 5:
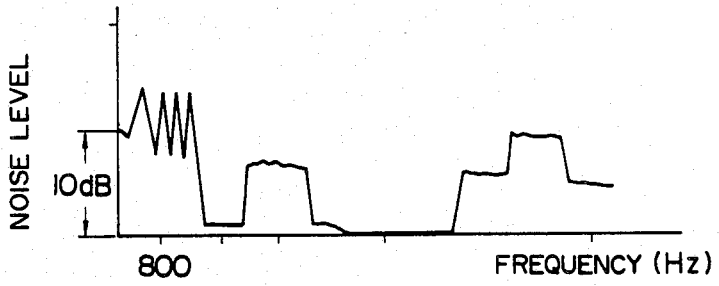
FIG. 5 PRIOR ART
FIG. 5 is a graphical illustration of the noise measurement in FIG. 4.
Figure 6:
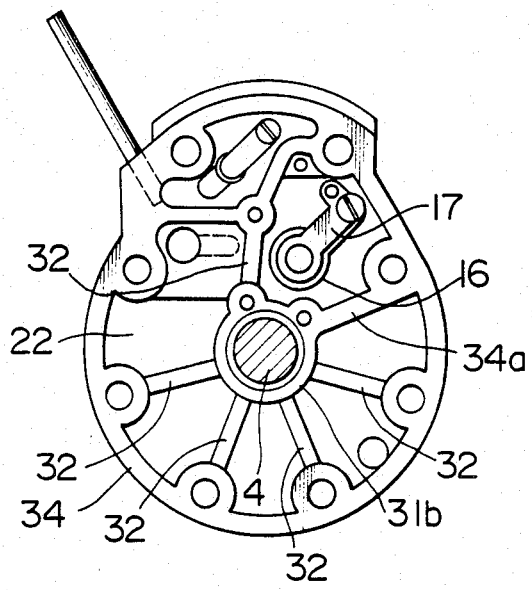
FIG. 6 PRIOR ART
FIG. 6 is an elevational view showing a discharge silencer of another conventional compressor.
Figure 7:
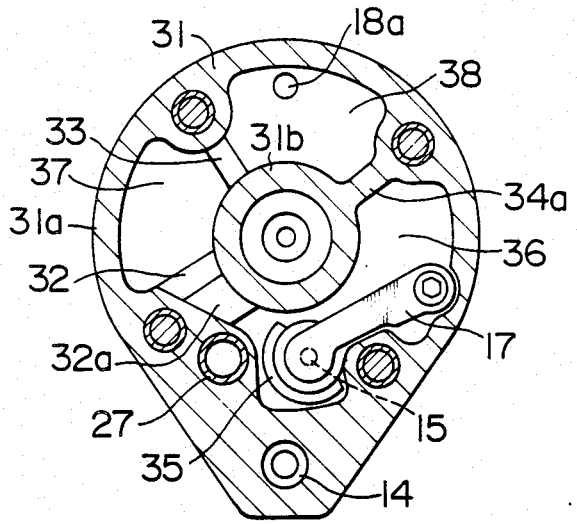
FIG. 7 is an elevational view of a discharge silencer to which the present invention is applied.

Referring now to FIG. 7, according to the invention, a sub-bearing 31 is provided with three partitioning walls 32, 33 and 34*a* between an outer circumferential wall 31*a* and a bearing boss 31*b*, with the walls 32, 33, 34*a* defining a plurality of small chambers in the sub-bearing 31. These small chambers include a first chamber 36 receiving an oil discharge valve 16, a second chamber 37 and a third chamber 38 and form a discharge silencer. The partitioning wall 34*a*, between the first and third chambers, is at the same level as that of the outer circumferential wall 31*a* and the bearing boss 31*b*, and is brought into intimate contact with an inner wall of a cover 39. With such a structure, a discharge gas 21 and oil 20*a* are introduced in order through the first chamber 36, the second chamber 37, and the third chamber 38 into a discharge gas hole 18*a*. Since the partitioning wall 34*a* is in intimate contact with the inner wall of the cover 39, the direction of flow of the oil is restricted. The cover 39 is fixedly secured to a main bearing 5 by fastening bolts 23 in such a manner that the cover 39 is brought into contact with the partitioning wall 34*a*, the outer circumferential wall 31*a* and the bearing boss 31*b* as shown in FIG. 7. Furthermore, the cover 39 is provided with an oil drain hole 39*b* at a position where the discharge silencer is opened to the second chamber 37, so that the oil contained within the discharge silencer is discharged to the outside through the oil drain hole 39*b*.

Figure 8:
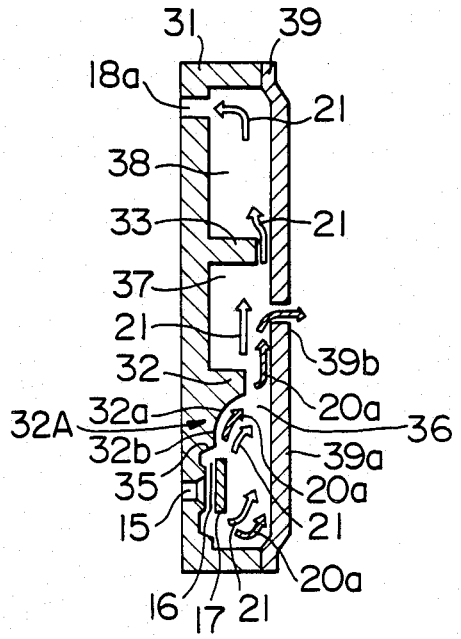
FIG. 8 is a cross sectional view of the discharge silencer shown in FIG. 7.

As shown most clearly in FIG. 8, a tapered portion 35 is formed along a circumferential portion of the discharge valve 16. A slant portion generally designated by the reference numeral 32A is formed in the partitioning wall 32 between the first chamber 36 and the second chamber 37 and is confronted with the first chamber 36. The slant portion 32A includes a first slant portion 32*a* and a second slant portion 32*b*, with the tapered portion 35 being formed continuously with the slant portion 32A. The oil 20*a*, discharged from the discharge port 15 is liable to be deflected along the curve of the tapered portion 35 and the slant portion 32A together with the discharge gas 21. The deflected oil 20*a* is transmitted along the inner wall of a projected portion 39*a* of the cover 39 and is discharged to the outside of the discharge silencer 22 from the oil drain hole 39*b* opened to the second chamber 37.

It will be understood that the provision of the slant portion 32A increases the discharge amount of the oil but the slant portion 32A is not always formed. The slant portion 32A may be provided as desired.

As described above, since the high temperature and high pressure refrigerant do not co-exist with the high temperature oil within the discharge silencer, the oil is not discharged into the refrigerating cycle. In addition, since the responsibility of the oil discharge valve 16 is enhanced, there is no reduction of the refrigerating preformance and a counterflow of the discharge gas is prevented from being generated. Also, since the oil is not introduced into the low pressure chamber, the input is not increased and, therefore, it is possible to provide a compressor having a high efficiency without any reduction of the compression efficiency of the compressor. Also, since the oil does not exist even if the compressor is maintained at a high temperature, the carbonization of the oil may be avoided.

Figure 9:
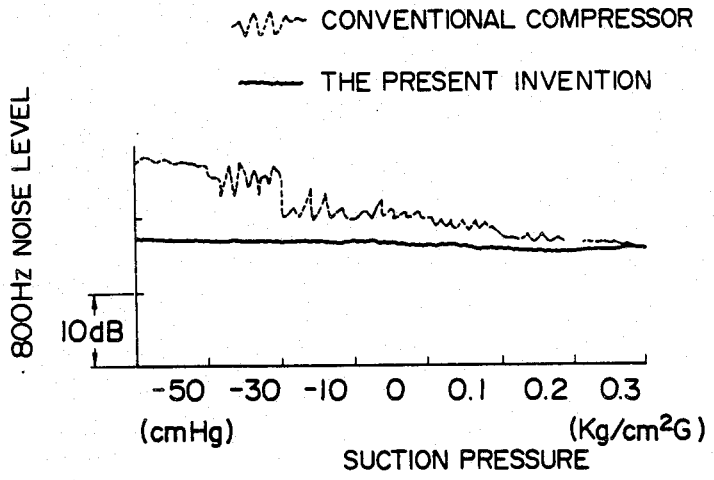
FIG. 9 is a graphical illustration a relationship between a suction pressure and a noise level at a specific frequency.

As shown in FIG. 9, the noise level within the 800 Hz range is not increased in accordance with the invention, and, incidentally, the rotary compressor according to the present invention has the same effect regardless of its physical size.

In the embodiment of FIGS. 7 and 8, the case where the discharge silencer is provided on the side of the sub-bearing has been explained but the like structure may be applied to a compressor in which the discharge valve 16 is mounted on the main bearing. In the latter case, the same effect may be obtained.

Figure 10:
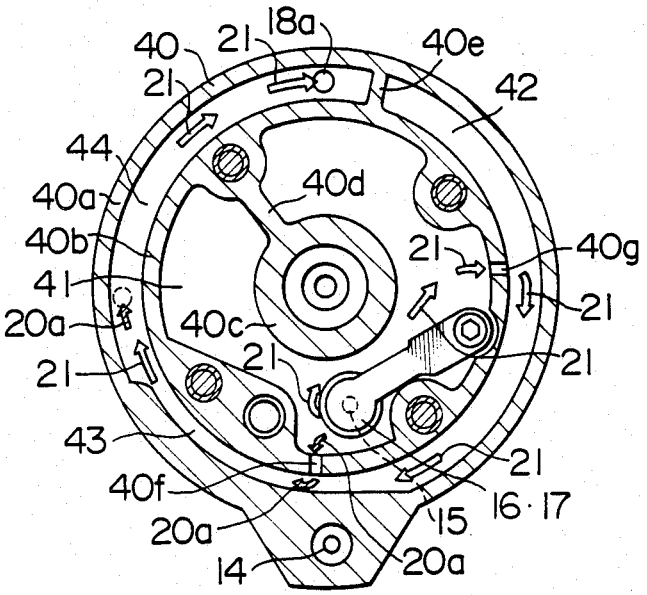
FIG. 10 is a cross sectional elevational view of a discharge silencer in accordance with another embodiment of the invention.
Figure 11:
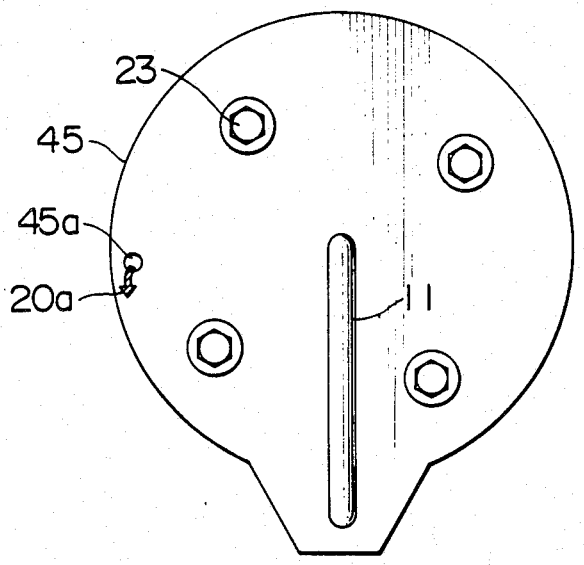
FIG. 11 is an elevational view of a planar silencer cover mounted on the silencer of FIG. 10.

In FIGS. 10 and 11, a sub-bearing 40 is provided with a substantially cylindrical partitioning wall 40*b* between an outer circumferential rib 40*a* and a bearing boss 40*c*. The sub-bearing 40 includes a radial partitioning wall 40*d* for connecting the bearing boss 40*c* and the substantially cylindrical partitioning wall 40*b* to each other and a radial partitioning wall 40*e* for connecting the substantially cylindrical partitioning wall 40*b* and the outer circumferential rib 40*a* to each other. A discharge silencer is composed of a first chamber 41, receiving therein a discharge valve 16, a second chamber 42, and a third chamber 44. The first and second chambers 41 and 42 communicate with each other through a groove 40*g* formed in the partitioning wall 40*b*. The second and third chambers 42 and 44 communicate with each other through a long groove 43. An oil drain groove 40*f* is formed at a location below the level of the discharge valve 16 in the first chamber 41, with the oil drain groove 40*f* communicating with the long groove 43.

The compressor according to the present invention shown in FIGS. 10 and 11 operates in the following manner. By rotation of the electric drive element 2, the rotary shaft 4 is rotated with the roller 7 being eccentrically rotated along the inner wall of the cylinder 6. A low pressure gas sucked from a suction pipe (not shown) by the rotation of the roller 7 is compressed and is discharged from the discharge port 15 into the first chamber 41 of the discharge silencer. As described above, at this time, the oil 20*a* is also simultaneously discharged into the first chamber 41. The oil 20*a* is discharged through the oil drain groove 40*f* to the long groove 43. The discharge gas 21 passes through the groove 40*g* to the second chamber 42, and thereafter is introduced into the third chamber 44 through the long groove 43. When the discharge gas 21 passes through the long groove 43, the oil 20*a* is blown up by the flow rate of the discharge gas. Therefore, the oil within the first chamber 41 may be continuously blown up. Also, as shown in FIG. 11, an oil drain small hole 45*a* is provided at a location communicating with the third chamber of the discharge silencer, so that the oil within the third chamber 44 may be quickly discharged to the outside of the discharge silencer.

Figure 12:
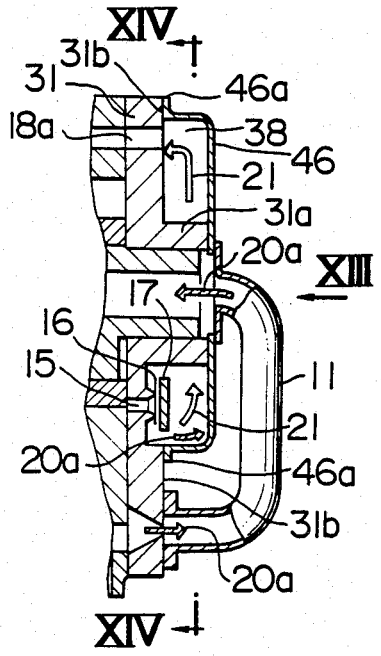
FIG. 12 is a fragmentary longitudinal cross sectional view of a compression section illustrating still another embodiment of the invention.
Figure 13:
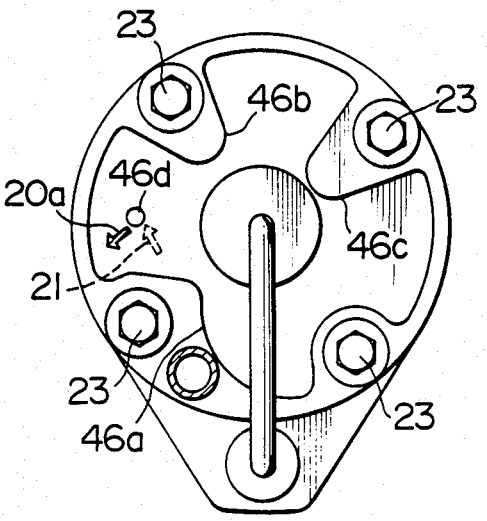
FIG. 13 is an elevational view of a silencer cover mounted on the silencer of FIG. 12, as viewed in a direction of the arrow XIII in FIG. 12.
Figure 14:
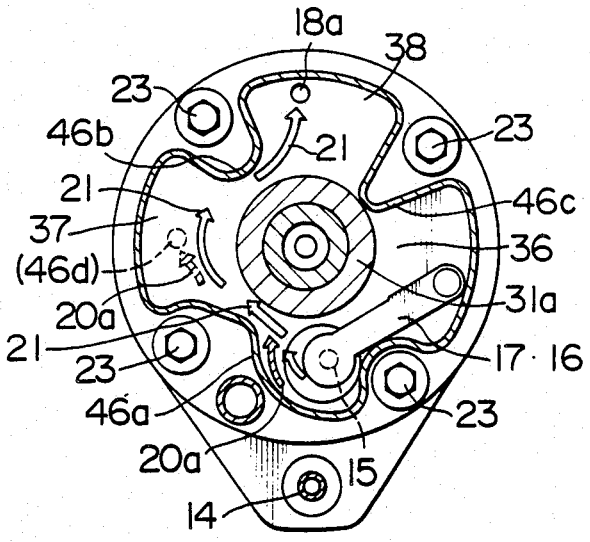
FIG. 14 is a cross-sectional view taken along the line XIV—XIV of FIG. 12.

In FIGS. 12–14, an outer end face 46*a* of a cup-shaped discharge silencer 46 is brought into intimate contact with an end face 31*b* of a sub-bearing 31 and is fixedly secured thereto by fastening bolts 23 with a space defined between an inside of the cup and the sub-bearing being used as the silencer space. A restriction 46*c* contacts a base 31*a* of the sub-bearing 31 in the radial direction, so that the flow of the discharge gas 21 is restricted to a clockwise direction in FIG. 14. Since the space for the discharge silencer is not in the form of a ring, a generation of cavity resonance is prevented. By a restriction 46*a*, formed around the discharge port 15 by reduction-machining, and another restriction 46*b*, added at any desired position, the discharge silencer is separated into a plurality of chambers including a first chamber 36, a second chamber 37 and a third chamber 38. The restriction 46*a* is in the form of a round shape having a radius of curvature R and surrounds the discharge port 15 and the discharge valve 16, so that the oil 20*a* discharged from the discharge port 15 to the first chamber 36 is liable to be blown up by the discharge gas 21. Furthermore, as shown in FIG. 13, an oil drain hole 46*d* is provided at a location opened to the second chamber 37 of the discharge silencer, so that the oil blown up by the round shaped restriction 46*a* may be discharged to the outside (inside of the casing 1).

We claim:

1. A horizontal type rotary compressor comprising a bearing means for rotatably supporting a rotary shaft connecting an electric drive element and a compression element, a planar cover means secured to an end face of said bearing means, a plurality of partitioning walls provided in said bearing in a confronted relationship to said planar cover means, a slant portion formed in a part of one of said partitioning walls for deflecting oil in a direction of the cover means, and small hole means formed in at least one of said planar cover means for enabling a communication between an inside and an outside of said bearing means whereby the deflected oil from the slant portion is discharged through said hole means.

2. A horizontal type rotary compressor as set forth in claim 1, wherein at least one of said plurality of partitioning walls is brought into intimate contact with said planar cover means so as to restrict a direction of flow of oil in the compressor, and said slant portion is formed in another of said partitioning walls.

3. A horizontal type rotary compressor, according to claim 1, wherein at least three partition walls are provided for respectively defining therebetween at least a first chamber, a second chamber and a third chamber, with said first, second, and third chambers forming a discharge silencer means for the compressor, and wherein said slant portion is provided on one of the partition walls disposed in an area of a discharge port means of the compressor.

4. A horizontal type rotary compressor, according to claim 3, wherein at least one of said plurality of partitioning walls is brought into intimate contact with said planar cover means so as to restrict a direction of flow of oil in the compressor.

5. A horizontal type rotary compressor comprising a bearing means for rotatably supporting a rotary shaft connecting an electric drive element and a compression element, planar cover means secured to an end face of said bearing, a plurality of small chambers defined by a plurality of partitioning walls provided in said bearing means in confronted relationship to said planar cover means, a discharge valve means provided in at least one of said small chambers, a slant portion formed in a part of one of said partitioning walls for direction oil in a predetermined discharge direction, and a small hole means formed in at least one of said planar cover means for communicating an inside and an outside of said bearing means whereby the deflected oil from the slant portion is discharged through said hole means.

6. A horizontal type rotary compressor as set forth in claim 5, wherein said slant portion is located on the side of said discharge valve means.

7. A horizontal type rotary compressor according to claim 5, wherein said plurality of said partition walls are arranged so as to form a cup-shaped discharge silencer means for the compressor, and include a plurality of restrictions for defining therebetween said plurality of small chambers.

8. A horizontal type rotary compressor according to claim 5, wherein said plurality of partitioning walls includes a substantially cylindrical partitioning wall arranged between an outer circumferential rib and a bearing boss of the bearing means, a radial partitioning wall for connecting the bearing boss and the substantially cylindrical partitioning wall, and a further radial partitioning wall for connecting the substantially cylindrical partitioning wall and the outer circumferential rib, said plurality of small chambers defined by said partitioning walls including a first chamber, a second chamber, and a third chamber, with the first, second and third chambers forming a discharge silencer means for the compressor, means in one of the partitioning walls for communicating the first and second chambers with each other, means provided in another of the partitioning walls for communicating the second and third chambers with each other, means for draining oil from the first chamber, and means for communicating said draining means with said means for communicating said second and third chambers with each other.

9. A horizontal type rotary compressor according to claim 8, wherein said means for communicating the first and second chambers with each other includes a groove formed in said one of the partitioning walls, and wherein said means for communicating said second and third chambers to each other include groove means defined between said substantially cylindrical partition wall and the outer circumferential rib.

* * * * *